US011665486B2

(12) United States Patent
Gomez

(10) Patent No.: US 11,665,486 B2
(45) Date of Patent: May 30, 2023

(54) HEARING AID SYSTEM CONTAINING AT LEAST ONE HEARING AID INSTRUMENT WORN ON THE USER'S HEAD, AND METHOD FOR OPERATING SUCH A HEARING AID SYSTEM

(71) Applicant: Sivantos Pte. Ltd., Singapore (SG)

(72) Inventor: Gabriel Gomez, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 64 days.

(21) Appl. No.: 17/352,534

(22) Filed: Jun. 21, 2021

(65) Prior Publication Data

US 2021/0400400 A1 Dec. 23, 2021

(30) Foreign Application Priority Data

Jun. 18, 2020 (DE) ..... 102020207585.9

(51) Int. Cl.
*H04R 25/00* (2006.01)

(52) U.S. Cl.
CPC ..... *H04R 25/407* (2013.01); *H04R 25/405* (2013.01); *H04R 25/505* (2013.01); *H04R 2225/021* (2013.01); *H04R 2225/43* (2013.01)

(58) Field of Classification Search
CPC .. H04R 25/407; H04R 25/405; H04R 25/505; H04R 2225/021; H04R 2225/43; H04R 2430/20; H04R 3/005; H04R 25/552; H04R 1/406; H04R 2225/41; H04R 2225/55
See application file for complete search history.

(56) References Cited

U.S. PATENT DOCUMENTS

| | | | |
|---|---|---|---|
| 8,600,086 | B2 | 12/2013 | Jensen et al. |
| 8,600,087 | B2 | 12/2013 | Fischer |
| 8,804,979 | B2 | 8/2014 | Elmedyb et al. |
| 9,301,049 | B2 | 3/2016 | Elko et al. |
| 9,596,551 | B2 | 3/2017 | Pedersen |
| 9,749,754 | B2 | 8/2017 | Merks |

(Continued)

FOREIGN PATENT DOCUMENTS

| | | | |
|---|---|---|---|
| DE | 102009012166 | A1 | 9/2010 |
| EP | 2439958 | A1 | 4/2012 |

(Continued)

*Primary Examiner* — Tuan D Nguyen
(74) *Attorney, Agent, or Firm* — Laurence A. Greenberg; Werner H. Stemer; Ralph E. Locher

(57) ABSTRACT

A hearing aid system assists a user's ability to hear. The system has a hearing aid instrument worn on the user's head. A sound signal from the user's surroundings is recorded and converted into input audio signals by two input transducers. The input audio signals are processed in a signal processing step for generating an output audio signal, which is output by an output transducer. The input audio signals or audio signals derived therefrom by pre-processing are direction-dependently damped by an adaptive beamformer according to the stipulation of a variable directivity with a directional strength to generate a directed audio signal. The directivity is varied with a specified adaptation speed such that the energy content of the directed audio signal is minimized. The adaptation speed and/or the directional strength are variably set on a basis of an analysis of the input audio signals or of the pre-processed audio signals.

11 Claims, 6 Drawing Sheets

(56) References Cited

U.S. PATENT DOCUMENTS

| | | | | |
|---|---|---|---|---|
| 9,813,825 | B2 | 11/2017 | Bjelosevic et al. | |
| 9,826,318 | B2 | 11/2017 | Pedersen et al. | |
| 10,524,061 | B2 | 12/2019 | Pedersen et al. | |
| 2017/0295437 | A1* | 10/2017 | Bertelsen ..... | H04R 25/405 |
| 2020/0329318 | A1* | 10/2020 | Elmedyb ..... | H04R 25/552 |

FOREIGN PATENT DOCUMENTS

| | | | |
|---|---|---|---|
| EP | 2611220 | A2 | 7/2013 |
| EP | 2941019 | A1 | 11/2015 |
| EP | 2908550 | B1 | 7/2018 |
| WO | 2004016037 | A1 | 2/2004 |
| WO | 2005029914 | A1 | 3/2005 |
| WO | 2007106399 | A2 | 9/2007 |

* cited by examiner

HEARING AID SYSTEM CONTAINING AT LEAST ONE HEARING AID INSTRUMENT WORN ON THE USER'S HEAD, AND METHOD FOR OPERATING SUCH A HEARING AID SYSTEM

CROSS-REFERENCE TO RELATED APPLICATION

This application claims the priority, under 35 U.S.C. § 119, of German patent application DE 10 2020 207 585.9, filed Jun. 18, 2020; the prior application is herewith incorporated by reference in its entirety.

BACKGROUND OF THE INVENTION

Field of the Invention

The invention relates to a hearing aid system for assisting a user's ability to hear, containing at least one hearing aid instrument worn on the user's head, in particular in or on an ear. Further, the invention relates to a method for operating such a hearing aid system.

A hearing aid instrument generally refers to an electronic device which assists the ability of a person wearing the hearing aid instrument (who is referred to as "wearer" or "user" below) to hear. In particular, the invention relates to hearing aid instruments which are set up to fully or partly compensate a loss of hearing of a hearing-impaired user. Such a hearing aid instrument is also referred to as "hearing aid". Additionally, there are hearing aid instruments which protect or improve the ability of users with normal hearing to hear, for example which intend to facilitate an improved understanding of speech in complicated hearing situations.

Hearing aid instruments in general and specifically hearing aids are usually embodied to be worn on the head of the user and, in particular, in or at an ear in this case, in particular as behind-the-ear devices (BTE devices) or in-the-ear devices (ITE devices). In terms of their internal structure, hearing aid instruments regularly include at least one (acousto-electric) input transducer, a signal processing unit (signal processor), and an output transducer. During the operation of the hearing aid instrument, the input transducer or each input transducer records airborne sound from the surroundings of the hearing aid instrument and converts the airborne sound into an input audio signal (i.e., an electric signal which transports information about the ambient sound). This at least one input audio signal is also referred to below as "recorded sound signal". The input audio signal or each input audio signal is processed in the signal processing unit (i.e., modified in terms of its sound information) in order to assist the ability of the user to hear, in particular to compensate for a loss of hearing of the user. The signal processing unit outputs a correspondingly processed audio signal (also referred to as "output audio signal" or "modified sound signal") to the output transducer.

In most cases, the output transducer is embodied as an electro-acoustic transducer which converts the (electric) output audio signal back into airborne sound, wherein this airborne sound—which is being modified in relation to the ambient sound—is output into the auditory canal of the user. In the case of a hearing aid instrument worn behind the ear, the output transducer, which is also referred to as "receiver", is usually integrated in a housing of the hearing aid instrument outside of the ear. The sound output by the output transducer is guided into the auditory canal of the user by a sound tube in this case. As an alternative thereto, the output transducer can also be arranged in the auditory canal, and consequently outside of the housing worn behind the ear. Such hearing aid instruments are also referred to as RIC devices (from "receiver in canal"). In-the-ear hearing aid instruments which are dimensioned to be so small that they do not protrude beyond the auditory canal to the outside are also referred to as CIC devices (from "completely in canal").

In further embodiments, the output transducer can also be formed as an electromechanical transducer which converts the output audio signal into structure-borne sound (vibrations), with this structure-borne sound being emitted to the cranial bone of the user, for example. Further, there are implantable hearing aid instruments, in particular cochlear implants, and hearing aid instruments whose output transducers directly stimulate the auditory nerve of the user.

The term "hearing aid system" denotes an individual device or a group of devices and possibly non-physical functional units, which together provide the functions required during the operation of a hearing aid instrument. In the simplest case, the hearing aid system can consist of a single hearing aid instrument. As an alternative thereto, the hearing aid system can include two cooperating hearing aid instruments for supplying both ears of the user. In this case, reference is made to a "binaural hearing aid system". In addition or as an alternative thereto, the hearing aid system can comprise at least one further electronic device, for example a remote control, a charger or a programming device for the hearing aid or each hearing aid. In the case of modern hearing aid systems, a control program, in particular in the form of a so-called app, is often provided instead of a remote control or a dedicated programming device, with this control program being embodied for implementation on an external computer, in particular a smartphone or tablet. In this case, the external computer itself is regularly not part of the hearing aid system, inasmuch as, as a rule, it is provided independently of the hearing aid system and not by the manufacturer of the hearing aid system either.

To damp noise during the operation of a hearing aid system, and hence, in particular, to improve the understanding of speech within communication between the user and another talker, direction-dependent damping (beamforming) of the input audio signal, by means of which the components of the input audio signals originating from different directions are damped to different extents according to the stipulation of a specified directivity, is often used within the scope of the signal processing in a hearing aid system. Frequently, the directivity has one or more directions of maximum damping, which are also referred to as notch or notches. In modern hearing aid systems, corresponding damping units (beamformers) sometimes have an adaptive embodiment. Such an adaptive beamformer autonomously varies its directivity in order to damp noise in optimized fashion. In particular, the notch is optionally aligned with a dominant noise source in the process in order to particularly effectively dampen the sound component emanating from this noise source.

To be able to follow noise sources that move relative to the head of the user (e.g., passing motor vehicles), an adaptive beamformer is often realized with a comparatively high adaptation speed. A high adaptation speed is furthermore also important in order to be able to compensate for head movements of the user because even a head movement of the user leads to the noise sources situated in the surroundings of the user moving—from the view of the user—relative to their head. In this case, the adaptation speed is regularly dimensioned to be so high that the adaptive beamformer can realign itself during a head rotation counter to the head rotation without a noticeable delay and consequently maintains the alignment with a certain noise source during and after the head rotation.

However, such quickly adapting beamformers frequently disadvantageously tend to generate negative effects (artifacts), which are perceived as unnatural by the user, in the case of dynamic hearing situations. Since the direction-dependent damping always influences other sound components in addition to the sound of the noise source to be damped—particularly in frequency ranges in which the noise is only weakly present or not present at all—the adaptation of the direction-dependent damping can lead to perceivable fluctuation of used signals or background noise in the sound signal output to the user. In inexpedient circumstances, such artifacts can severely impair the hearing perception of the user and, in extreme cases, even cause a deterioration in the understanding of speech (instead of the desired improvement). In particular, a fluctuation, caused by the adaptation of the direction-dependent damping, of background noises that are static per se can lead to an elevated perception of these background noises and consequently distract the user from concentrating on the actual used signal. In particular, particular bothersome effects can be caused by the notch of an adaptive beamformer jumping back and forth between different noise sources.

An approach of at least partly rectifying these problems, known from European patent EP 2 908 550 B1 (corresponding to U.S. Pat. Nos. 10,524,061, 9,826,318, and 9,596,551), for example, consists of detecting a head movement of the user by means of an acceleration, direction or inclination sensor and updating the "viewing direction" of the beamformer (i.e., the directional lobe) counter to the detected head movement. As an alternative thereto, EP 2 908 550 B1 has disclosed the practice of increasing the adaptation speed of an adaptive beamformer when a head movement of the user is detected by means of the sensor. Both approaches allow the beamformer to be configured with a comparatively low adaptation speed in the absence of head rotations such that the risk of artifacts of the above-described type is reduced in this situation.

However, in any case, these approaches do not help against artifacts of adaptive direction-dependent damping which are caused by noise sources moving independently of the head of the user (e.g., passing motor vehicles).

BRIEF SUMMARY OF THE INVENTION

The application is based on the object of improving adaptive direction-dependent damping used during the operation of a hearing aid system (for modifying the sound signal which is recorded from the surroundings and intended to be output to the user in modified form) in view of the avoidance of artifacts. Consequently, direction-dependent damping should be created, which facilitates a better hearing perception of the user.

In relation to a method, this object is achieved according to the invention by the features of the independent method claim 1. In relation to a hearing aid system, the object is achieved according to the invention by the features of independent hearing aid system 7. Advantageous configurations or developments of the invention, some of which are inventive on their own, are presented in the dependent claims and the following description.

Generally, the invention proceeds from a hearing aid system for assisting a user with the ability to hear, wherein the hearing aid system contains at least one hearing aid instrument that is worn on the user's head, in particular in or on an ear. As described above, the hearing aid system can consist exclusively of a single hearing aid instrument in simple embodiments of the invention. In another embodiment of the invention, the hearing aid system contains at least one further component in addition to the hearing aid instrument, for example a further hearing aid instrument (in particular an equivalent hearing aid instrument) for caring for the other ear of the user, a control program (in particular in the form of an app) to be carried out in an external computer (in particular a smartphone) of the user and/or at least one further electronic device, for example a remote control or a charger. In this case, the hearing aid instrument and the at least one further component exchange data, with functions of data storage and/or data processing of the hearing aid system being split among the hearing aid instrument and the at least one further component.

The hearing aid system contains at least two input transducers which serve to record one sound signal (in particular in the form of airborne sound) each from surroundings of the hearing aid instrument. The at least two input transducers can be arranged in the same hearing aid instrument, particularly if the hearing aid system contains only a single hearing aid instrument. In the case of a binaural hearing aid system with two hearing aid instruments, the at least two input transducers can alternatively also be distributed among the two hearing aid instruments.

Furthermore, the hearing aid system contains signal processing with a signal processing unit for processing (modifying) the recorded sound signal in order to assist the ability of the user to hear, and an output transducer for outputting the modified sound signal. In the case of a binaural hearing aid system, both hearing aid instruments preferably have a signal processing unit and an output transducer each. Instead of a second hearing aid instrument with input transducer, signal processing unit and output transducer, the hearing aid system within the scope of the invention can, however, also comprise a hearing aid instrument for the second ear without its own output transducer; instead, this hearing aid instrument for the second ear only records sound and transmits the latter—with or without signal processing—to the hearing aid instrument of the first ear. Such so-called CROS or BiCROS instruments are used for users with deafness on one side, in particular. Further, the signal processing or part of same can also be outsourced from the hearing aid instrument or the hearing aid instruments to an external unit, e.g., an app running on a smartphone, within the scope of the invention. In addition to the signal processing unit, the signal processing of the hearing aid system preferably contains a signal analysis unit which itself does not generate an audio signal to be output directly or indirectly to the user but which assists the function of the hearing aid system, in particular the signal processing unit, by analyzing audio signals or other sensor signals.

The hearing aid instrument or each hearing aid instrument of the hearing aid system is available, in particular, in one of the designs described at the outset (BTE device with internal or external output transducer, ITE device, e.g., CIC device, hearing implant, in particular cochlear implant, etc.) or as hearable. In the case of a binaural hearing aid system, both hearing aid instruments preferably have an embodiment of the same kind.

Each of the input transducers is, in particular, an acousto-electric transducer which converts airborne sound from the surroundings into an electric input audio signal. The output transducer or each output transducer is preferably embodied as an electro-acoustic transducer (receiver), which converts the audio signal modified by the signal processing unit back into airborne sound. Alternatively, the output transducer is embodied to output structure-borne sound or for directly stimulating the auditory nerve of the user.

Within the scope of the method, a sound signal is recorded from surroundings of the user and converted into input audio signals by the at least two input transducers of the hearing aid system. The input audio signals are processed in a signal processing step to generate an output audio signal. This output audio signal is output by means of the output transducer of the hearing aid instrument. In the signal processing step, the input audio signals are fed directly (or indirectly after pre-processing) to a first adaptive beamformer, by means of which the input audio signals, or the audio signals derived therefrom by the pre-processing (pre-processed audio signals), are direction-dependently damped according to a stipulation of a variable (first) directivity with a specified (first) directional strength. In the process, the first adaptive beamformer generates a first directed audio signal, which is output directly (or indirectly after one or more further signal processing steps) to the electro-acoustic transducer as the modified audio signal for output to the user.

In an adaptation step, the directivity of the first adaptive beamformer is varied depending on a specified (first) adaptation speed such that the energy content of the first directed audio signal is minimized.

In general, the "directivity" of a beamformer denotes the dependence of the damping of sound components of the recorded sound signal undertaken by the beamformer on the basis of the direction from which these sound components are received.

In this case, the deviation of the directivity from the omnidirectivity is expressed, in particular, in that the direction-dependent damping of the associated adaptive beamformer has at least one local maximum. This damping maximum or each damping maximum of the directivity is in this case also referred to as "notch" below, the associated direction of the maximum damping is also referred to as "notch direction".

In an expedient embodiment of the invention, the notch direction or each notch direction is defined in the form of an angle specification, for example relative to the viewing direction of the user. Alternatively, the notch direction or each notch direction can also be indicated as an abstracted variable—which is correlated with the alignment of the associated notch in linear or nonlinear fashion—for example in the form of a weighting factor used to weight different basic directional signals (e.g., a cardioid signal and an anti-cardioid signal, etc.) for the purposes of setting conventional adaptive beamformers, or in the form of a variable time delay with which different signal components are superposed for the purposes of generating the directional effect.

The "directional strength" generally describes how strongly the directivity of the associated adaptive beamformer deviates from an omnidirectivity (i.e., signal processing without a directional dependence). In certain embodiments of the invention, the directional strength of the first adaptive beamformer is unchangeable. In this case, the directional strength is defined, in particular implicitly, by the functional structure or the design of the first adaptive beamformer.

In general, the "adaptation speed" describes how quickly the associated adaptive beamformer adapts its directivity to a change in the noise background (i.e., the spatial distribution of the noise sources and consequently of the sound components in the input audio signals). In certain embodiments of the invention, the adaptation speed of the first adaptive beamformer is unchangeable. In this case, the adaptation speed is defined, in particular implicitly, by the functional structure of the first adaptive beamformer.

However, according to the invention, at least one of the two above-described properties of the directivity, specifically the adaptation speed and/or the directional strength, of the first adaptive beamformer is not unchangeable but is specified for the first adaptive beamformer as a variable, consequently as a changeable parameter. The adaptation speed or the directional strength of the first adaptive beamformer is variably set in this case (preferably by the above-described signal analysis unit) on the basis of an analysis of the input audio signals or the pre-processed audio signals.

As a result of the variability of the adaptation speed and/or the directional strength of the first adaptive beamformer it is possible to effectively avoid artifacts of the above-described type. In particular, this allows the adaptation speed, and hence the adaptability, of the first adaptive beamformer to be temporarily increased if changes in the noise background require a substantial adjustment of the first beamformer. In this way, it is possible in particular to avoid a perceivable delay in the adaptation of the first adaptive beamformer to a movement of a noise source relative to the head. As an alternative or in addition thereto, a similar effect is obtained by a temporary reduction in the directional strength. On the other hand, the first adaptation speed can be set low however in static hearing situations and so there is an avoidance of artificial fluctuations of used signals or background noises on account of small-scale adaptations of the directivity of the first adaptive beamformer. In this case, a comparatively high directional strength facilitates good damping of noises and consequently a good perception of the used signal by the user, and consequently simplifies the understanding of speech, in particular, within the scope of communication between the user and another speaker. Here, the invention is based on the recognition that controlling the adaptation speed and/or the directional strength of the first adaptive beamformer on the basis of an analysis of the input audio signals or of the pre-processed audio signals allows particularly effective avoidance of artifacts from direction-dependent damping.

The two above-described measures, i.e., varying the adaptation speed of the first adaptive beamformer on the one hand and varying the directional strength of the first adaptive beamformer on the other hand, contribute to this effect being obtained independently of one another as a matter of principle. These measures can therefore be used independently of one another within the scope of the invention, by virtue of varying either only the adaptation speed or only the directional strength of the first adaptive beamformer. However, both the adaptation speed and the directional strength of the first adaptive beamformer are varied in a preferred embodiment of the method.

Preferably, the adaptation speed and/or the directional strength of the first adaptive beamformer are set depending on the time stability of the input audio signals or of the pre-processed audio signals (more precisely, depending on the time stability of the noise background underlying the input audio signals). In variants of the method where the adaptation speed of the first adaptive beamformer is varied, in particular, this is set low in the case of high time stability (i.e., weak temporal change) of the respective audio signals and is set high in the case of low time stability (i.e., significant temporal change). This leads to the directivity of the first adaptive beamformer being adapted quickly in the case of a strongly changing noise background and being adapted slowly in the case of a weakly changing noise background. In variants of the method where the directional strength of the first adaptive beamformer is varied, in particular, this is set high in the case of high time stability (i.e., little temporal change) of the respective audio signals and is set low in the case of low time stability (i.e., significant temporal change). This leads to the input audio signals or the pre-processed audio signals being directed strongly by the first adaptive beamformer in the case of weakly changing noise background and being directed weakly or not even being directed at all in the case of strongly changing noise background. By way of example, a variable characterizing the noise background is derived from the input audio signals or the pre-processed audio signals for the purposes of determining the time stability. By way of example, the standard deviation of this variable or a root mean square of the first derivative of this variable with respect to time over a sliding period of time is used as a measure for the time stability. As an alternative or in addition thereto, it is also possible to use the rate with which a sliding mean value of this variable is exceeded or undershot (mean crossing rate) or the rate with which the first derivative of this variable changes the sign as a measure for the time stability of the input audio signals or the pre-processed audio signals.

To characterize the noise background, a second adaptive beamformer with a (second) variable directivity is used in an advantageous embodiment of the invention. This second adaptive beamformer—just like the first adaptive beamformer—is applied directly or indirectly to the input audio signals in order to generate a second directed audio signal. The directivity of the second adaptive beamformer is in this case set with a—preferably constant—(second) adaptation speed such that the energy content of the second directed audio signal is minimized. As is already the case for the first directivity, the second directivity is preferably characterized by at least one variable direction of maximum damping (notch direction). In an expedient embodiment of the invention, the second directed audio signal is however not included in the modified audio signal to be output to the user. Therefore, the second adaptive beamformer is only used for the purposes of signal analysis in this case. Here, the second directed audio signal is only used as controlled variable for energy minimization, and not for signal preparation for output to the user.

In particular, the adaptation speed of the second adaptive beamformer is chosen in such a way that it does not drop below the adaptation speed of the first adaptive beamformer and at least intermittently exceeds the latter. Thus, the second adaptive beamformer is always configured for fast adaptation such that it can adapt to changes in the noise background without significant delay. Consequently, the directivity of this second adaptive beamformer (in particular a notch direction optionally assigned to this directivity) forms a measure for the changeability of the noise background underlying the input audio signals. In comparison with the second adaptive beamformer, the first adaptive beamformer either adapts slowly at all times or alternates between slow and fast adaptation.

In an advantageous embodiment of the method, the adaptation speed and/or the directional strength of the first adaptive beamformer are variably set depending on the change in the second directivity (i.e., the directivity of the second adaptive beamformer). By way of example, a sliding root mean square of the first time derivative of a notch direction assigned to the second directivity is ascertained in this case as a characteristic variable for the temporal change of the second directivity and hence as a measure for the changeability of the noise background. By way of example, the adaptation speed of the first adaptive beamformer is increased over a base value and/or the directional strength of the first adaptive beamformer is reduced in relation to a base value if and for as long as the above-mentioned characteristic variable exceeds a specified threshold.

As an alternative or in addition thereto, the adaptation speed and/or the directional strength of the first adaptive beamformer are preferably set depending on the deviation of the second directivity from the first directivity, in particular depending on the deviation of a (second) notch direction assigned to the second directivity from a (first) notch direction assigned to the first directivity. By way of example, the adaptation speed of the first adaptive beamformer is increased and/or the directional strength of the first adaptive beamformer is reduced if and for as long as the above-mentioned deviation of the notch directions exceeds a specified threshold.

In a development of the above-described method variant, a plurality of adaptive beamformers, which correspond to the second adaptive beamformer, in particular, in terms of structure and functionality (and optionally also design), are used instead of the one second adaptive beamformer to analyze the input audio signals or the pre-processed audio signals and hence to set the first adaptation speed and/or the first directional strength. Here, this plurality of adaptive (analysis) beamformers are in particular coupled to one another such that a different alignment of their respectively assigned directivities (and optionally the associated notch directions) is forced. Consequently, what is achieved is that, in particular, each of the plurality of adaptive (analysis) beamformers is aligned with a different dominant noise source in the surroundings of the user. As a result of such a cascade of analysis beamformers, the noise background underlying the input audio signals and changes in this noise background can be analyzed with great precision.

Preferably, the first adaptive beamformer has a frequency dependence, i.e., modifies different frequency components of the input audio signals or of the pre-processed audio signals individually in each case. In particular, the input audio signals or the pre-processed audio signals are each divided into various frequency channels, wherein the directivity (in particular the notch direction or each notch direction) of the first adaptive beamformer is adapted individually for each frequency channel. In a preferred embodiment of the invention, the adaptation speed and/or the directional strength of the first adaptive beamformer are also specified here as frequency-dependent variable (e.g., as a vector with in each case an entry for each frequency channel or as a continuous frequency-dependent function) such that the directivity of the first adaptive beamformer is optionally adapted at different speeds for different frequencies or such that the directivity of the first adaptive beamformer optionally has a differently pronounced manifestation for different frequencies.

For setting the adaptation speed and/or the directional strength of the first adaptive beamformer in frequency-dependent fashion, at least one noise component, emanating from a noise source, is identified in the input audio signals or the pre-processed audio signals and analyzed in respect of its spectral composition in this case. Specifically, an interference frequency range corresponding to this noise component is ascertained. Here, the adaptation speed and/or the directional strength of the first adaptive beamformer are specified uniformly (i.e., with the same value) within the interference frequency range. This prevents the first beamformer from being adapted for different frequency components of one and the same noise in different ways, as doing this could lead to an acoustic distortion and/or an artificial fluctuation of the noise.

In general, the hearing aid system according to the invention is set up to automatically carry out the above-described method according to the invention. To this end, the hearing aid system contains the first adaptive beamformer (as described above). The hearing aid system furthermore contains an adaptivity controller which is set up to variably set the adaptation speed and/or the directional strength of the first adaptive beamformer on the basis of an analysis of the input audio signals or pre-processed audio signals.

The hearing aid system is set up in terms of programming and/or circuitry in order to automatically carry out the method according to the invention. Thus, the hearing aid system according to the invention contains programming means (software) and/or circuitry means (hardware, e.g., in the form of an ASIC), which automatically carry out the method according to the invention during the operation of the hearing aid system. The programming and/or circuitry means for carrying out the method, in particular the first adaptive beamformer and the adaptivity controller, can be arranged exclusively in the hearing aid instrument (or the hearing aid instruments) of the hearing aid system in this case. Alternatively, the programming and/or circuitry means for carrying out the method are distributed among the hearing aid instrument or the hearing aids and at least one further device or a software component of the hearing aid system. By way of example, programming means for carrying out the method are distributed among the at least one hearing aid instrument of the hearing aid system and a control program installed on an external electronic device (in particular a smartphone). As a rule, the external electronic device is itself not part of the hearing aid system in this case, as mentioned above.

The above-described embodiments of the method according to the invention correspond to corresponding embodiments of the hearing aid system according to the invention.

Thus, the adaptivity controller is set up in preferred embodiments of the invention to set the adaptation speed and/or the directional strength of the first adaptive beamformer depending on the time stability of the input audio signals.

Preferably, for the purposes of analyzing the input audio signals or the pre-processed audio signals (i.e., for characterizing the underlying noise background) and for ascertaining the adaptation speed and/or the directional strength of the first adaptive beamformer, the adaptivity controller contains a second adaptive beamformer or a cascade of further (in particular mutually coupled) adaptive beamformers, as described above.

In particular, the adaptivity controller is set up to variably set the adaptation speed and/or the directional strength of the first adaptive beamformer depending on the change in the (respective) directivity of the second beamformer (and optionally the further adaptive beamformers) and/or depending on the deviation of the directivities of the adaptive beamformers.

The first adaptive beamformer preferably has a frequency-dependent directivity (as described above), in particular a respectively individually adapted directivity for a plurality of frequency channels. The adaptivity controller is preferably set up here to specify the adaptation speed and/or the directional strength of the first adaptive beamformer as a frequency-dependent variable, to identify a noise component, emanating from a noise source, in the input audio signals or the pre-processed audio signals for the purposes of setting the adaptation speed and/or the directional strength of the first adaptive beamformer, to ascertain an interference frequency range corresponding to the noise component, and to uniformly specify the adaptation speed and/or the directional strength of the first adaptive beamformer in the interference frequency range.

Effects and advantages of the individual method variants are transferable to the corresponding variants of the hearing aid system, and vice versa.

Other features which are considered as characteristic for the invention are set forth in the appended claims.

Although the invention is illustrated and described herein as embodied in a hearing aid system containing at least one hearing aid instrument worn on the user's head, and a method for operating such a hearing aid system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and variables corresponding to one another are always provided with the same reference signs in all figures.

Figure 1:
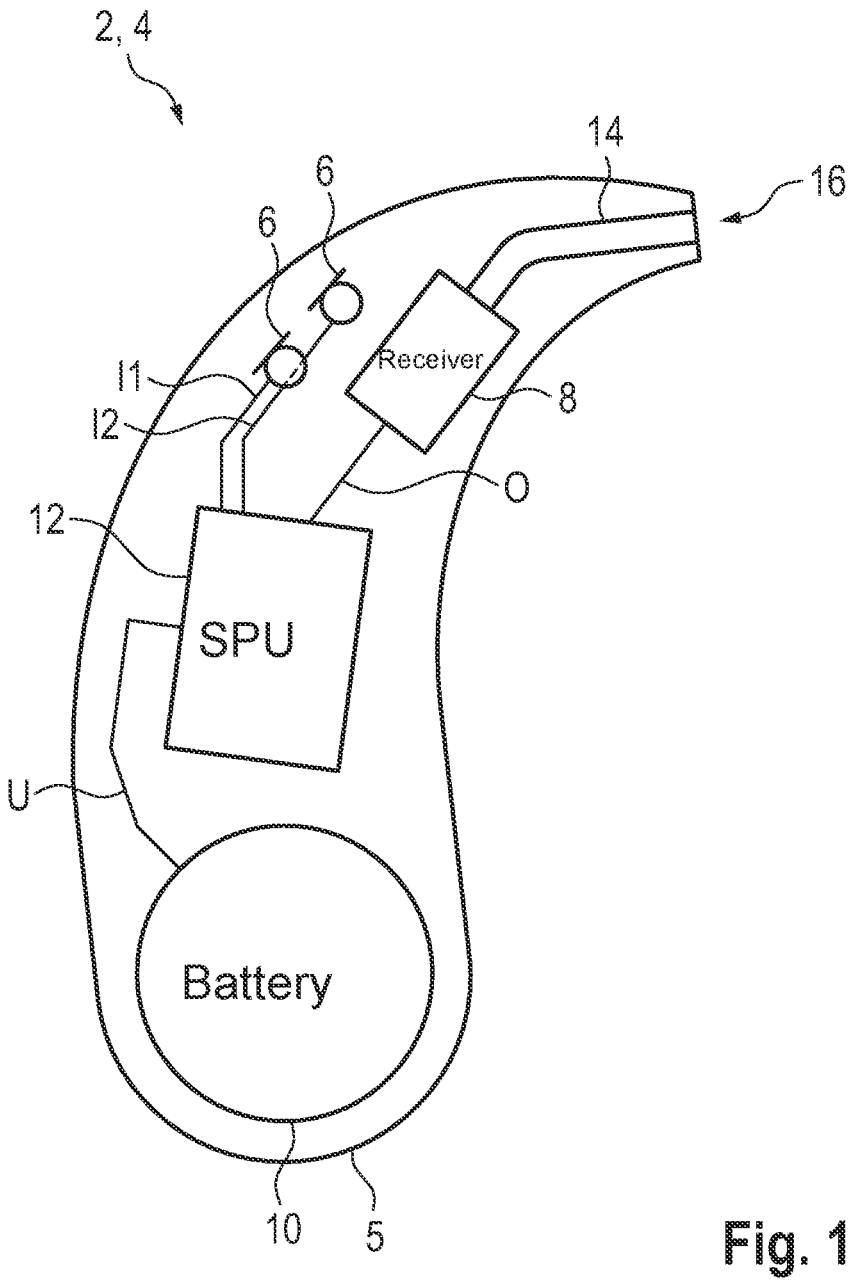
FIG. 1 is a schematic illustration of a hearing aid system formed of a single hearing aid instrument and being in a form of a hearing aid that is wearable behind an ear of a user.

Referring now to the figures of the drawings in detail and first, particularly to FIG. 1 thereof, there is shown a hearing aid system 2 which consists in this case of a single hearing aid 4, i.e., a hearing aid instrument set up to assist the ability of a hearing-impaired user to hear. In the example illustrated here, the hearing aid 4 is a BTE hearing aid, which is able to be worn behind an ear of a user.

Optionally, in a further embodiment of the invention, the hearing aid system 2 contains a second hearing aid, not expressly illustrated, which serves to supply the second ear of the user and which corresponds in terms of its setup to the hearing aid 4 illustrated in FIG. 1 in particular.

Within a housing 5, the hearing aid 4 contains two microphones 6 as acousto-electric input transducers and a receiver 8 as electro-acoustic output transducer. The hearing aid 4 furthermore contains battery 10 and a signal processing in the form of a signal processor 12. Preferably, the signal processor 12 contains both a programmable subunit (e.g., a microprocessor) and a non-programmable subunit (e.g., an ASIC).

The signal processor 12 is fed with a supply voltage U from the battery 10.

During normal operation of the hearing aid 4, the microphones 6 each record airborne sound from the surroundings of the hearing aid 4. The microphones 6 each convert the sound into an (input) audio signal I1 and I2, respectively, which contains information about the recorded sound. Within the hearing aid 4, the input audio signals I1, I2 are fed to the signal processor 12, which modifies these input audio signals I1, I2 to assist the ability of the user to hear.

The signal processor 12 outputs an output audio signal O, which contains information about the processed and hence modified sound, to the receiver 8.

The receiver 8 converts the output sound signal O into modified airborne sound. This modified airborne sound is transferred into the auditory canal of the user via a sound channel 14, which connects the receiver 8 to a tip 16 of the housing 5, and via a flexible sound tube (not explicitly shown), which connects the tip 16 with an earpiece inserted into the auditory canal of the user.

Figure 2:
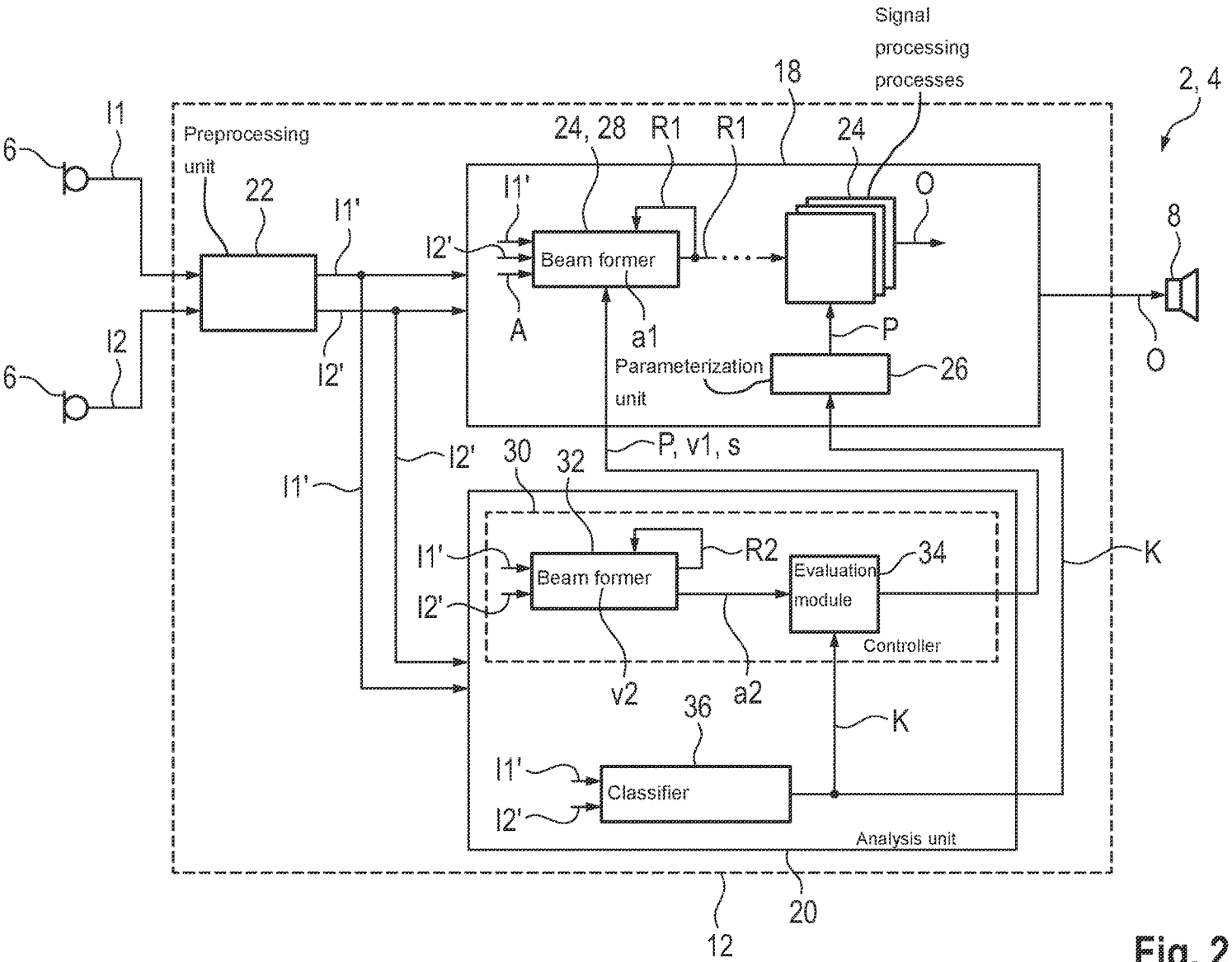
FIGS. 2 to 4 are circuit blocking diagrams each showing a structure of signal processing of the hearing aid system of FIG. 1 in three alternative embodiments.

The structure of the signal processing is illustrated in more detail in FIG. 2. From this, it is evident that the signal processing of the hearing aid system 2 is organized in two functional constituent parts, specifically a signal processing unit 18 and a signal analysis unit 20. The signal processing unit 18 serves to generate the output audio signal O from the input audio signals I1, I2 of the microphones 6 or, in this case, from audio signals I1', I2' derived from pre-processing, which have consequently been pre-processed. In the case mentioned first, the input audio signals I1, I2 of the microphones 6 are directly fed to the signal processing unit 18. In the latter case, illustrated in FIG. 2 in exemplary fashion, the input audio signals I1, I2 of the microphones 6 are initially fed to a pre-processing unit 22, which then derives the pre-processed audio signals I1', I2' therefrom and supplies these to the signal processing unit 18.

In the pre-processing unit 22, the input audio signals I1, I2 are preferably superposed on one another with a time offset to form the pre-processed audio signals I1', I2', in such a way that the two pre-processed audio signals I1', I2' correspond to a cardioid signal or an anti-cardioid signal.

The signal processing unit 18 contains a number of signal processing processes 24, which successively process the input audio signals I or—in the example as per FIG. 2—the internal audio signals I1', I2' and modify these in the process in order to generate the output audio signal O and hence compensate the loss of hearing of the user.

The signal processing processes 24 are optionally implemented in any combination in the form of (non-programmable) hardware circuits and/or in the form of software modules (firmware) in the signal processor 12. By way of example, at least one of the signal processing processes 24 is formed by a hardware circuit, at least one further one of the signal processing processes 24 is formed by a software module and yet another one of the signal processing processes 24 is formed by a combination of hardware and software constituent parts. By way of example, the signal processing processes 24 comprise:

a process for suppressing noise and/or feedback,
a process for dynamic compression, and
a process for frequency-dependent amplification on the basis of audiogram data,
etc.

Here, at least one signal processing parameter P is assigned in each case to at least one of these signal processing processes 24 (as a rule, to all signal processing processes 24 or at least to most signal processing processes 24). The or each signal processing parameter P is a one-dimensional variable (binary variable, natural number, floating-point number, etc.) or a multi-dimensional variable (array, function, etc.), the value of which parameterizes (i.e., influences) the functionality of the respectively assigned signal application process 24. In this case, signal processing parameters P can activate or deactivate the respectively assigned signal processing process 24, can continuously or incrementally amplify or weaken the effect of the respectively assigned signal processing process 24, can define time constants for the respective signal processing process 24, etc.

By way of example, the signal processing parameters P comprise a) the aforementioned audiogram data or frequency-specific gain factors derived therefrom, for a process for frequency-dependent amplification,
b) a characteristic for a process for dynamic compression,
c) a control variable for continuously setting the strength of a process for noise and/or feedback suppression,
d) etc.

In any case, some of the signal processing parameters P are made available to the signal processing processes 24 from a parameterization unit 26.

Moreover, the signal processing processes 24 comprise a first adaptive beamformer 28—illustrated in more detail in FIG. 2—which is set up to direction-dependently damp the input audio signals I1, I2 (or, as illustrated in FIG. 2, the pre-processed audio signals I1', I2') according to the stipulation of a variable (first) directivity and to thus generate a first directed audio signal R1. The beamformer 28 generates the audio signal R1 by virtue of superposing the two fed audio signals I1', I2' (i.e., a cardioid signal and an anti-cardioid signal in the example as per FIG. 2), which are weighted by means of a first weighting factor a1:

$$R1=I1'-a1\cdot I2' \text{ with } a=[-1;1] \qquad \text{Eq. 1}$$

Here, the weighting factor a1 determines a notch direction in which—as seen relative to the head of the user—the direction-dependent damping of the beamformer 28 has a (local) maximum. Consequently, the weighting factor a1 represents a measure for the notch direction of the beamformer 28 and is therefore conceptually equated to this notch direction below. To adapt the directivity, the weighting factor a1 is varied in a closed-control method by the beamformer 28 in an adaptation step such that the energy content of the directed audio signal R1 is minimized (this self-regulation of the beamformer 28 is illustrated schematically in FIG. 2 by returning the audio signal R1 to the beamformer 28). What the described energy minimization achieves is that noise from a spatial region behind the head of the user is suppressed to the best possible extent. The directed audio signal R1 output by the beamformer 28 is processed further by the further signal processing processes 24, as a result of which the output audio signal O is generated. The beamformer 28 is preferably formed by a software module.

A first adaptation speed v1 is variably specified for the beamformer 28 as signal processing parameters P. This adaptation speed v1 is determined in the signal analysis unit 20 by a functional unit denoted adaptivity controller 30, which is preferably implemented in software.

In the embodiment illustrated in FIG. 2, the adaptivity controller 30 contains a second adaptive beamformer 32 and an evaluation module 34.

In respect of structure and function, the second adaptive beamformer 32 preferably corresponds to the first adaptive beamformer 28. Consequently, in the manner described above, the second adaptive beamformer 32 is set up to direction-dependently damp the input audio signals I1, I2 (or, as illustrated in FIG. 2, the pre-processed audio signals I1', I2') according to the stipulation of a (second) variable directivity and to thus generate a second directed signal R2. The directivity of the beamformer 32 preferably has a notch direction which is characterized by a variable weighting factor a2. The weighting factor a2 (and hence the notch direction) is varied by the beamformer 32 with an adaptation speed v2 in such a way that the energy content of the directed audio signal R2 is minimized.

In contrast to the beamformer 28, the beamformer 32 does not serve to generate the output audio signal O output to the user but only serves to analyze the noise background underlying the input signals I1, I2. Therefore, the audio signal R2 is not processed further but only returned to the beamformer 32 for the purposes of self-regulation. Instead, the beamformer 32 outputs as analysis result the weighting factor a2 which indicates the notch direction (and hence indirectly the arrangement of the most dominant noise sources in the surroundings of the user) to the evaluation module 34.

In the evaluation module 34, the time stability (or—expressed conversely—the time variability) of the weighting factor a2 and hence of the noise background is evaluated in the embodiment as per FIG. 2, for example by virtue of forming a sliding temporal root mean square value over the first time derivative of the weighting factor a2. The evaluation module 34 varies the adaptation speed v1 for the first adaptive beamformer 28 on the basis of this variable. In a simple but expedient embodiment variant, the evaluation module 34 varies the adaptation speed v1 in binary fashion here, between a comparatively low base value and a value that has been increased in relation thereto. Here, the evaluation module 34 sets the adaptation speed v1 to the base value if and for as long as the above-described mean value does not exceed a specified threshold (which indicates that the noise background is not changeable or only weakly changeable). Consequently, the first beamformer 28 only adapts slowly in this case, as a result of which artifacts as a consequence of the adaptation are largely avoided. Otherwise, i.e., if and for as long as the mean value exceeds the threshold on account of a significant change in the noise background and the weighting factor a2, the adaptation speed v1 is increased relative to the base value such that the first adaptive beamformer 28 can quickly adapt to the altered hearing situation (in particular without perceivable delay).

To analyze the noise background with great precision, the second adaptive beamformer 32 has a quickly adapting embodiment. Here, the adaptation speed v2 is chosen (preferably as a constant) in such a way that it never drops below the variable adaptation speed v1 of the first adaptive beamformer 28 (v2≥v1).

In addition or as an alternative to the adaptation speed v1, a directional strength s of the first adaptive beamformer 28 is preferably also variable. Here, the variation in the directional strength s is realized, for example, by virtue of the weighted sum as per Eq. 1 being mixed at different levels with an omnidirectional audio signal A which is derived from the input audio signals I1, I2 (and which is optionally supplied to the beamformer 28 as per FIG. 2 as an additional input variable). Here, the directional strength s is reduced by the evaluation module 34 in relation to a specified base value if and for as long as a significant changeability of the noise background is determined—in particular on the basis of the threshold being exceeded described above.

As can further be gathered from FIG. 2, the signal analysis unit 20 optionally comprises a classifier 36 in addition to the adaptivity controller 30 and preferably in addition to further functions for sound analysis not explicitly illustrated here, said classifier, in a manner conventional per se, analyzing the current hearing situation by analyzing the input audio signals I1, I2 (or the pre-processed audio signals I1', I2' as illustrated in FIG. 2) in view of their similarity to a plurality of typical hearing situation classes (such as, e.g., "speech", "speech with background noise" or "music") and outputting a corresponding classification signal K.

The classification signal K is supplied firstly to the parameterization unit 26, which, in a manner conventional per se, makes a selection between different hearing programs, i.e., different parameter sets of the signal processing parameters P which are each optimized for one of the typical hearing situation classes, depending on the classification signal K.

Secondly, the classification signal K is also supplied to the evaluation module 34 of the adaptivity controller 30 and influences the determination of the adaptation speed v1 and/or the directional strength s there. By way of example, the values between which the adaptation speed v1 and/or the directional strength s are varied are altered in turn on the basis of the classification signal K.

Figure 3:
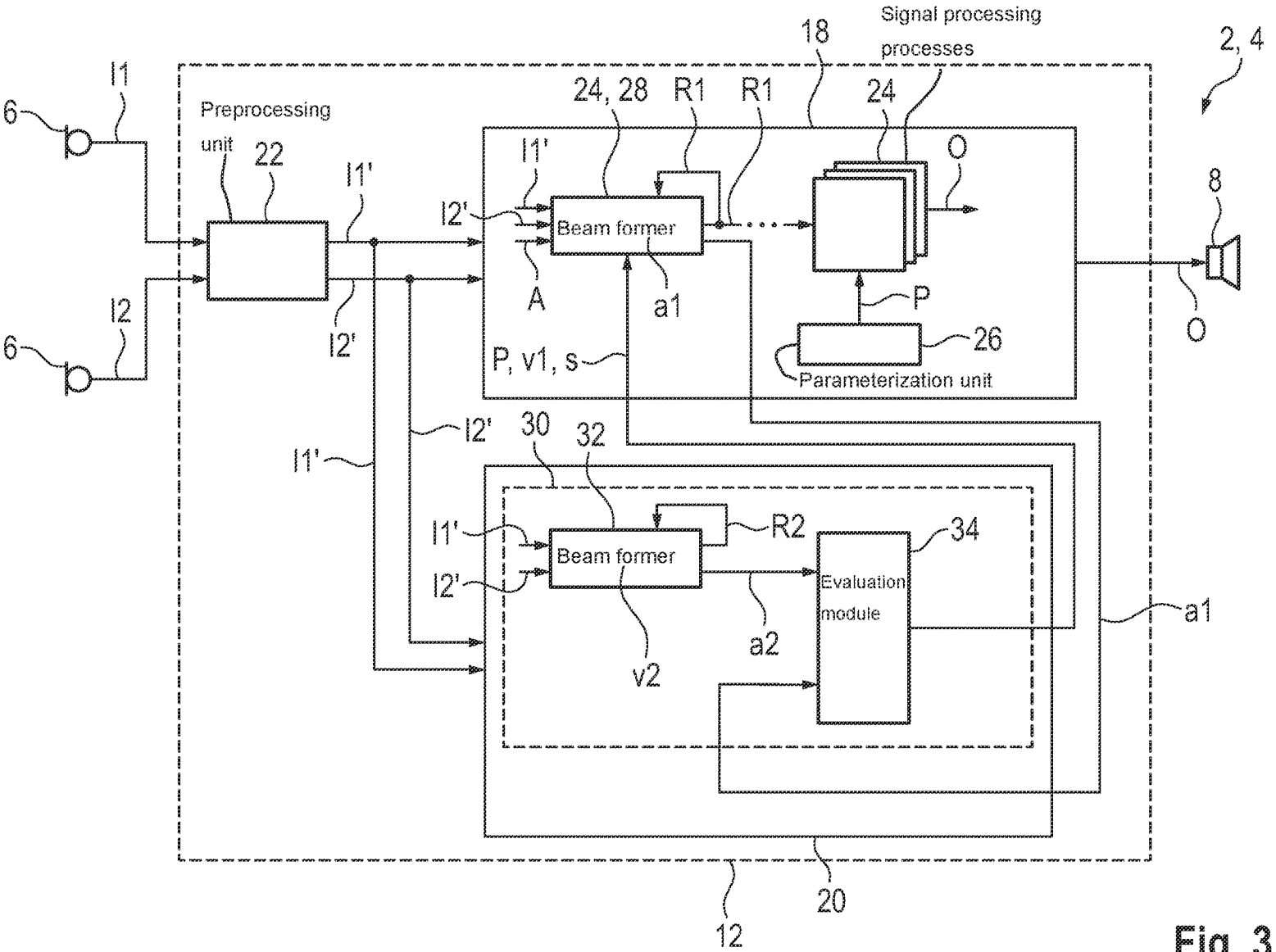

FIG. 3 illustrates an alternative embodiment of the hearing aid system 2. In contrast to the embodiment as per FIG. 2, the weighting factor a1 of the beamformer 28 is supplied to the evaluation module 34 in the embodiment as per FIG. 3, in addition to the weighting factor a2 of the beamformer 32. Here, the evaluation module 34 analyzes the changeability of the noise background underlying the input audio signals I1, I2 and the audio signals I1', I2' by virtue of comparing the weighting factors a1 and a2. A great deviation of the quickly changeable weighting factor a1 from the weighting factor a2, which changes slowly in the base state, is considered an indication here for a substantial change in the noise background. Accordingly, the evaluation module 34 increases the adaptation speed v1 and/or reduces the directional strength s if and for as long as the difference between the weighting factors a1 and a2 exceeds a specified threshold.

Figure 4:
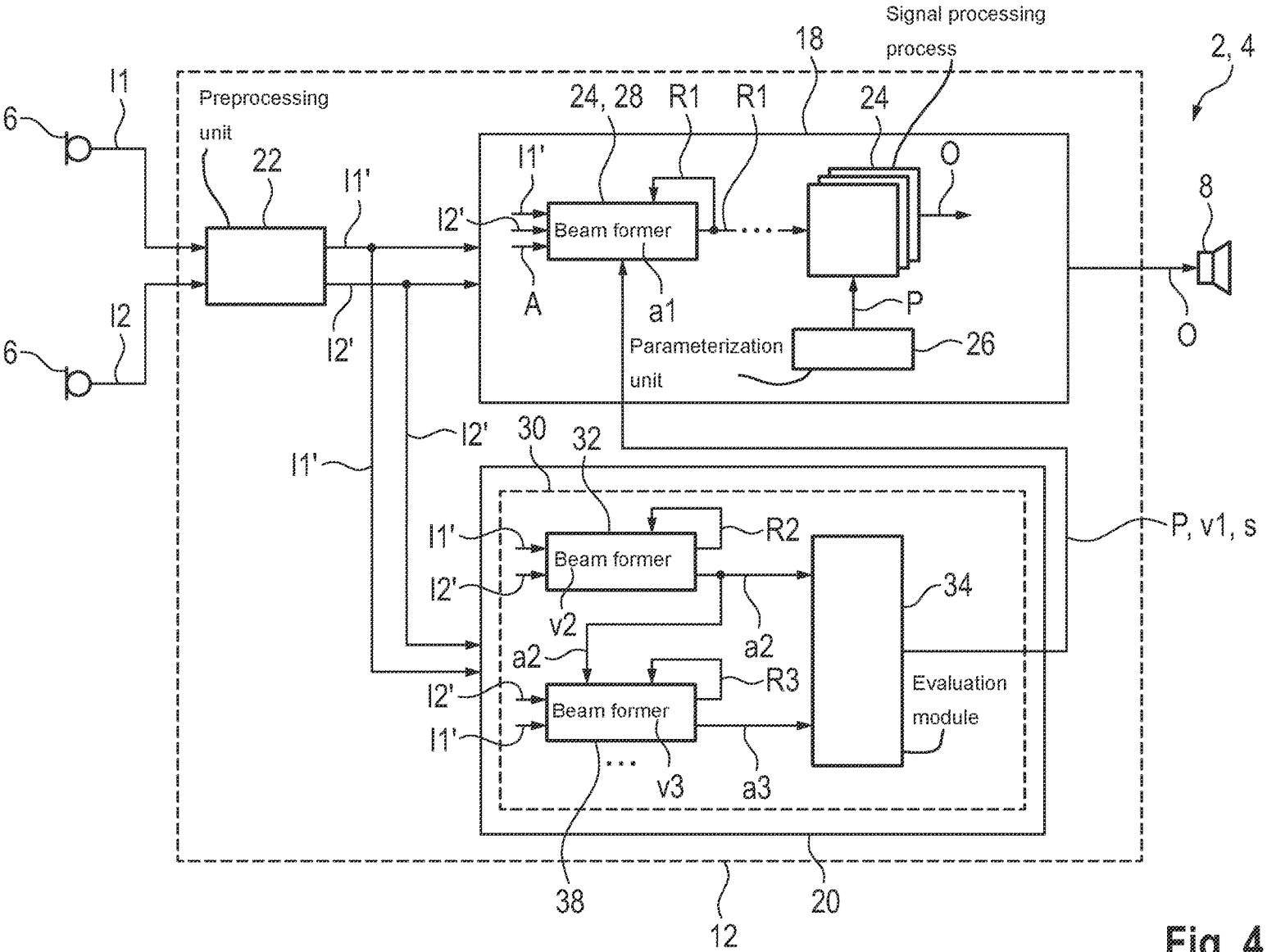

FIG. 4 illustrates a further embodiment of the hearing aid system 2. In contrast to the embodiments as per FIGS. 2 and 3, the adaptivity controller 30 in this case comprises, in addition to the second adaptive beamformer 28, at least one further adaptive beamformer 28 which generates a further directed audio signal R3 and, on account of an energy minimization of this audio signal R3, varies an associated further weighting factor a3 (as a measure for a changeable notch direction of the beamformer 38).

In an expedient embodiment variant, an adaptation speed v3 that is assigned to the beamformer 38 and preferably specified to be constant has a value below the adaptation speed v2 and, in particular, corresponding exactly or approximately to the base value of the adaptation speed v1. In this case, the further adaptive beamformer 38 consequently has a slowly adapting embodiment in comparison with the second adaptive beamformer 32, with both beamformers 32 and 38 setting the respective weighting factor a2 and a3, respectively, preferably independently of one another (coupling of the beamformers 32 and 38, as indicated in FIG. 4 on the basis of the supply of the weighting factor a2 to the beamformer 38, is preferably not provided in this embodiment variant). The changeability of the noise background underlying the input audio signals I1, I2 and the pre-processed audio signals I1', I2' is determined here by the evaluation module 34 in a manner analogous to the exemplary embodiment as per FIG. 3 on the basis of the deviations between the weighting factors a2 and a3 of the beamformers 32 and 38.

In an alternative embodiment variant, the adaptation speeds v2 and v3 of the beamformers 32 and 38 are chosen to be exactly the same or approximately the same such that both beamformers 32 and 38 adapt quickly. In this case, the beamformers 26 and 38 are preferably coupled to one another—as indicated in FIG. 4—such that a different setting of the weighting factors a2 and a3 is forced. This coupling ensures that the beamformers 26 and 38 adjust to different dominant noise sources in the surroundings of the user. In this case, the changeability of the noise background underlying the input audio signals I1, I2 and the pre-processed audio signals I1', I2' is determined here by the evaluation module 34 in a manner preferably analogous to the exemplary embodiment as per FIG. 2 on the basis of the time stability of the weighting factors a2 and a3. Here, in particular, the adaptation speed v1 is increased and/or the directional strength s is lowered if the condition for increasing the adaptation speed v1 and/or reducing the directional strength s is satisfied for at least one of the weighting factors a2 and a3.

The classifier 36 is optionally also present in the exemplary embodiments as per FIGS. 3 and 4 and not also illustrated in these figures purely for reasons of clarity.

Preferably, the signal processing in the signal processing unit 18 is implemented in frequency-resolved fashion in a plurality of frequency channels (e.g., 64 frequency channels). In this case, preferably even before being supplied to the pre-processing unit 22, the input audio signals I1, I2 are respectively split into frequency components by an analysis filter bank (not explicitly illustrated in FIGS. 2 to 4), the frequency components being processed individually in each case in the frequency channels and subsequently being merged in a synthesis filter bank (likewise not explicitly illustrated in FIGS. 2 to 4) to form the output audio signal O.

In this case, the first adaptive beamformer 28 is set up to direction-dependently damp, in each case on an individual basis, the frequency components of the input audio signals I1, I2 or of the pre-processed audio signals I1', I2' carried in the frequency channels. Consequently, the directivity of the beamformer 28 and the associated notch direction or the weighting factor a1 also have a frequency dependence. Preferably, the weighting factor a1 and/or the directional strength s are each specified as a vector, which has an associated individual value for each frequency channel. Moreover, the directivity of the beamformer 28 is preferably also adapted on an individual basis for each frequency channel. Consequently, the adaptation speed v1 is also preferably specified as a vector, which has an associated individual value for each frequency channel.

To prevent a noise originating from a certain sound source being perceivably distorted by the beamformer 28 as a consequence of a frequency-specific different adaptation of the directivity, the adaptivity controller 30 is preferably set up to couple frequency channels, which carry essential frequency components of a dominant noise, in respect of the adaptation speed v1 and/or the directional strength s. Expressed differently, the adaptivity controller 30 specifies the adaptation speed v1 and/or the directional strength s in uniform fashion (i.e., with the same value) for those frequency channels which carry essential frequency components of a dominant noise.

For this purpose, the second adaptive beamformer 32 (and optionally the third adaptive beamformer 38) are preferably also designed analogous to the beamformer 28, in such a way that they direction-dependently damp, in each case on an individual basis, the frequency components of the input audio signals I1, I2 or of the pre-processed audio signals I1', I2' carried in the frequency channels. Consequently, the noise background is analyzed in frequency-resolved fashion by the second adaptive beamformer 32 (and optionally the third adaptive beamformer 38).

Figure 5:
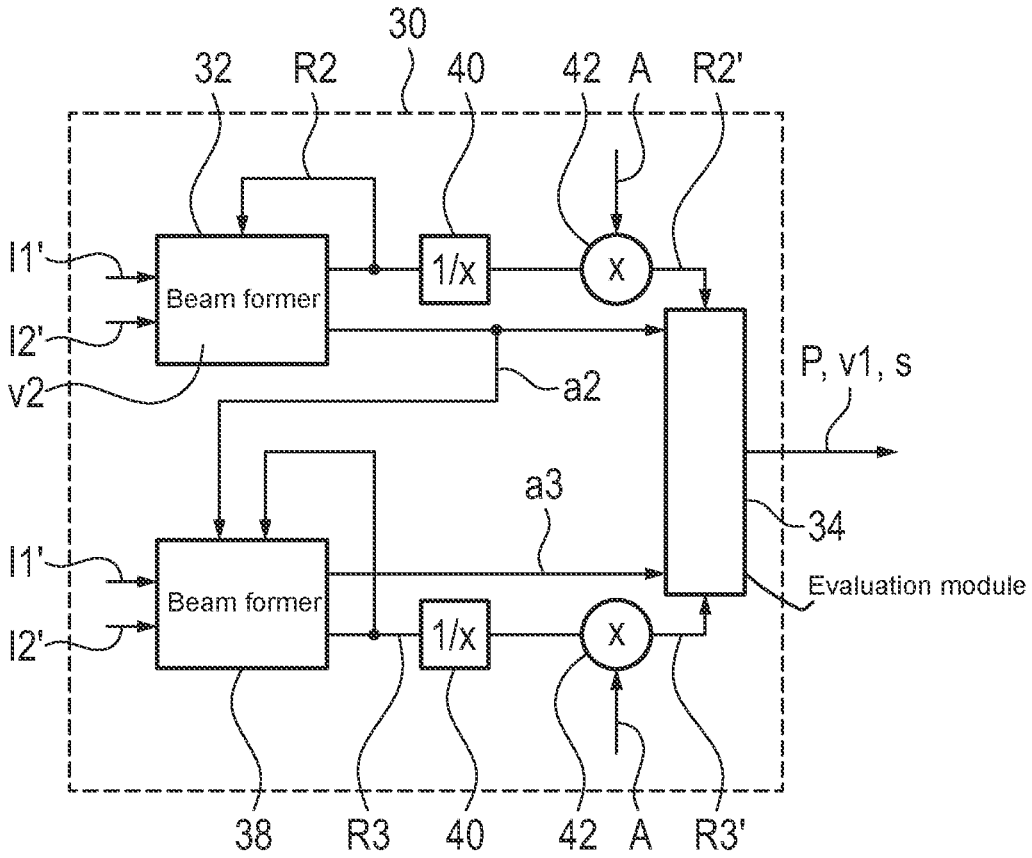
FIG. 5 is a circuit block diagram, in an illustration as per FIGS. 2 to 4, a functional unit, referred to as adaptivity controller, of the signal processing of the hearing aid system in a further embodiment.

To ascertain the spectral composition of one or more dominant noises, the directed audio signal R2 (and R3 respectively) output by the second adaptive beamformer 32 (and optionally the third adaptive beamformer 38) is inverted in an inverter member 40 and subsequently multiplied by the omnidirectional audio signal A in a multiplier member 42. This signal processing is shown in FIG. 5 in exemplary fashion for an embodiment of the adaptivity controller 30 which, in a manner analogous to FIG. 4, comprises both the second adaptive beamformer 32 and the third adaptive beamformer 38. By multiplying the omnidirectional audio signal A with the inverted, directed audio signal R2 (or R3), an audio signal R2' (or R3') arises, in which precisely the dominant noise, which was selectively filtered out for the second adaptive beamformer 32 (or optionally the third adaptive beamformer 38), is selectively amplified. The audio signal R2' (or optionally R3') is now fed to the evaluation module 34, which analyzes the spectral composition of the audio signal R2' (or optionally R3') and ascertains an interference frequency range corresponding to the respective noise. The frequency channels located in this interference frequency range are coupled here by the evaluation module 34 in respect of the adaptivity of the first adaptive beamformer 28 by virtue of the evaluation module 34 uniformly specifying the values of the adaptation speed v1 and/or the directional strength s corresponding to these frequency channels. By way of example, the adaptation speed v1 is increased in relation to the base value for all coupled frequency channels and/or the directional strength s is reduced in relation to the base value for all coupled frequency channels if and for as long as it emerges (from the evaluation of the weighting factor a2 or the weighting factors a2 and a3 undertaken by the evaluation module 34 as per FIG. 2 or 4) that the condition for increasing the adaptation speed v1 or reducing the directional strength s is satisfied for at least one of the coupled frequency channels.

Figure 6:
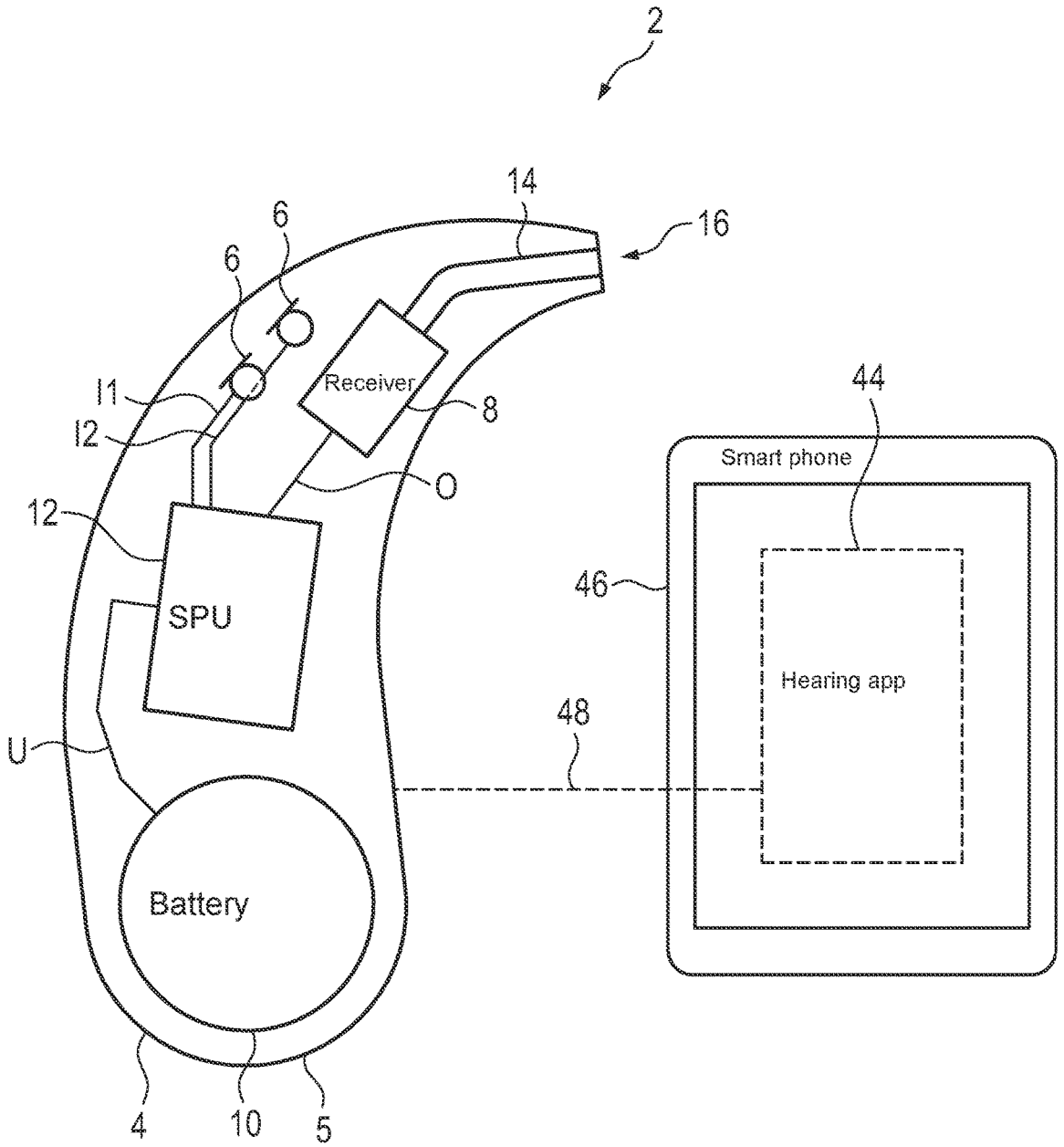
FIG. 6 is an illustration as per FIG. 1, of an alternative embodiment of the hearing aid system in which the latter contains a hearing aid instrument in the form of a behind-the-ear hearing aid and a control program implemented on a smartphone ("hearing app").

FIG. 6 shows a further embodiment of the hearing aid system 2, in which the latter comprises control software in addition to the hearing aid 4 (or two hearing aids of this type for supplying the two ears of the user). This control software is referred to as hearing app 44 below. The hearing app 44 is installed on a smartphone 46 in the example illustrated in FIG. 5. Here, the smartphone 46 itself is not part of the hearing aid system 2. Rather, the smartphone 46 is only used as a resource for memory and computing power by the hearing app 44.

The hearing aid 4 and the hearing app 46 exchange data via a wireless data transmission link 48 during the operation of the hearing aid system 2. By way of example, the data transmission link 48 is based on the Bluetooth standard. In this case, the hearing app 44 accesses a Bluetooth transceiver of the smartphone 46 in order to receive data from the hearing aid 4 and in order to transmit data to the latter. In turn, the hearing aid 4 contains a Bluetooth transceiver (not explicitly illustrated) in order to transmit data to the hearing app 44 and to receive data from this app.

In the embodiment as per FIG. 6, parts of the signal processing shown in FIGS. 2 to 5 (e.g., the adaptivity controller 30) are not implemented in the signal processor 12 of the hearing aid 4 but instead in the hearing app 44.

The invention becomes particularly clear on the basis of the above-described exemplary embodiments although it is equally not restricted to these exemplary embodiments. Rather, further embodiments of the invention can be derived by a person skilled in the art from the claims and the above description. In particular, the individual features of the hearing aid system and of the associated operating method respectively explained on the basis of the various exemplary embodiments can also be combined differently with one another within the scope of the claims without leaving the scope of the invention.

The following is a summary list of reference numerals and the corresponding structure used in the above description of the invention:

2 Hearing aid system
4 Hearing aid
5 Housing
6 Microphone
8 Receiver
10 Battery
12 Signal processor
14 Sound channel
16 Tip
18 Signal processing unit
20 Signal analysis unit
22 Pre-processing unit
24 Signal processing process
26 Parameterization unit
28 (First adaptive) beamformer
30 Adaptivity controller
32 (Second adaptive) beamformer
34 Evaluation module
36 Classifier
38 (Third adaptive) beamformer
40 Inverter member
42 Multiplier member
44 Hearing app
46 Smartphone
48 Data transmission link
a1 (First) weighting factor
a2 (Second) weighting factor
a3 (Third) weighting factor
s Directional strength
v1 (First) adaptation speed
v2 (Second) adaptation speed
v3 (Third) adaptation speed
A (Omnidirectional) audio signal
I1, I2 Input audio signal
I1', I2' (Internal) audio signal
K Classification signal
O Output audio signal
P Signal processing parameter
R1 (First directed) audio signal
R2 (Second directed) audio signal
R3 (Third directed) audio signal
U Supply voltage

The invention claimed is:

1. A method for operating a hearing aid system for assisting a user's ability to hear, the hearing aid system having at least one hearing aid instrument worn on a head of the user, which comprises the steps of:

recording a sound signal from surroundings of the user and converting the sound signal into input audio signals by means of at least two input transducers of the hearing aid system;

processing the input audio signals in a signal processing step to generate an output audio signal, wherein in the signal processing step, the input audio signals or pre-processed audio signals derived therefrom by pre-processing are direction-dependently damped by means of a first adaptive beamformer according to a stipulation of a first variable directivity with a directional strength in order to generate a first directed audio signal;

varying a directivity of the first adaptive beamformer with a first adaptation speed in such a way during an adaptation step an energy content of the first directed audio signal is minimized, wherein the first adaptation speed and/or the directional strength are variably set on a basis of an analysis of the input audio signals or of the pre-processed audio signals;

applying a second adaptive beamformer with a second variable directivity to the input audio signals or the pre-processed audio signals to generate a second directed audio signal for purposes of setting the first adaptation speed and/or the directional strength for the first adaptive beamformer;

setting a second variable directivity of the second adaptive beamformer with a second adaptation speed in such a way that an energy content of the second directed audio signal is minimized, wherein the second adaptation speed does not drop below the first adaptation speed and at least intermittently exceeds the latter; and outputting the output audio signal by means of an output transducer of the hearing aid instrument.

2. The method according to claim 1, which further comprises setting the first adaptation speed and/or the directional strength in dependence on a time stability of the input audio signals or of the pre-processed audio signals.

3. The method according to claim 1, which further comprises variably setting the first adaptation speed and/or the directional strength in dependence on a change in the second variable directivity.

4. The method according to claim 1, which further comprises setting the first adaptation speed and/or the directional strength in dependence on a deviation of the second variable directivity from the first variable directivity.

5. The method according to claim 1, wherein:

the first variable directivity is frequency dependent such that different frequency components of the input audio signals or of the pre-processed audio signals are individually direction-dependently damped in each case;

the first adaptation speed and/or the directional strength are specified for the first adaptive beamformer as a frequency-dependent variable;

a noise component, emanating from a noise source, in the input audio signals or in the pre-processed audio signals is identified for the purposes of setting the first adaptation speed and/or the directional strength;

an interference frequency range corresponding to the noise component is ascertained; and the first adaptation speed and/or the directional strength are uniformly specified in the interference frequency range.

6. The method according to claim 1, which further comprises wearing the at least one hearing aid instrument in or on an ear of the user.

7. A hearing aid system for assisting a user's ability to hear, the hearing aid system comprising:

at least one hearing aid instrument worn on a head of the user and having an output transducer set up to output an output audio signal;

at least two input transducers set up to record a sound signal from surroundings of the user and convert the sound signal into input audio signals;

a signal processor set up to process the input audio signals to generate the output audio signal, said signal processor having a first adaptive beamformer set up to direction-dependently damp the input audio signals, or pre-processed audio signals derived therefrom by pre-processing, according to a stipulation of a first variable directivity with a directional strength in order to generate a first directed audio signal, and to vary the first variable directivity with a first adaptation speed in such a way that an energy content of the first directed audio signal is minimized;

an adaptivity controller set up to variably set the first adaptation speed and/or the directional strength on a basis of an analysis of the input audio signals or the pre-processed audio signals, said adaptivity controller further containing a second adaptive beamformer with a second variable directivity, to which the input audio signals or the pre-processed audio signals are fed, said second adaptive beamformer being set up to generate a second directed audio signal and to set the second variable directivity with a second adaptation speed in such a way that an energy content of the second directed audio signal is minimized, and the second adaptation speed does not drop below the first adaptation speed and at least intermittently exceeds the latter.

8. The hearing aid system according to claim 7, wherein said adaptivity controller is set up to set the first adaptation speed and/or the directional strength depending on a time stability of the input audio signals or of the pre-processed audio signals.

9. The hearing aid system according to claim 7, wherein said adaptivity controller is set up to variably set the first adaptation speed and/or the directional strength depending on a change in the second variable directivity.

10. The hearing aid system according to claim 7, wherein said adaptivity controller is set up to set the first adaptation speed and/or the directional strength depending on a deviation of the second variable directivity from the first variable directivity.

11. The hearing aid system according to claim 7, wherein:

the first variable directivity is frequency dependent such that different frequency components of the input audio signals or of the pre-processed audio signals are direction-dependently damped in different ways;

said adaptivity controller is set up to:

specify the first adaptation speed and/or the directional strength as a frequency-dependent variable;

identify a noise component, emanating from a noise source, in the input audio signals or in the pre-processed audio signals for purposes of setting the first adaptation speed and/or the directional strength;

ascertain an interference frequency range corresponding to the noise component; and uniformly specify the first adaptation speed and/or the directional strength in the interference frequency range.

* * * * *